US009856656B2

(12) United States Patent
Pervan

(10) Patent No.: US 9,856,656 B2
(45) **Date of Patent: *Jan. 2, 2018**

(54) MECHANICAL LOCKING OF FLOOR PANELS WITH A GLUED TONGUE

(71) Applicant: Ceraloc Innovation AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/597,578

(22) Filed: Jan. 15, 2015

(65) Prior Publication Data

US 2015/0121796 A1 May 7, 2015

Related U.S. Application Data

(60) Continuation of application No. 14/042,887, filed on Oct. 1, 2013, now Pat. No. 8,959,866, which is a (Continued)

(30) Foreign Application Priority Data

| | | |
|---|---|---|
| Jul. 5, 2011 | (SE) | 1150635-9 |
| Aug. 26, 2011 | (SE) | 1150775-3 |
| Aug. 29, 2011 | (SE) | 1150777-9 |

(51) Int. Cl.
*E04F 15/02* (2006.01)
*E04F 15/04* (2006.01)
(Continued)

(52) U.S. Cl.
CPC ..... *E04F 15/02038* (2013.01); *E04B 1/40* (2013.01); *E04F 13/076* (2013.01);
(Continued)

(58) Field of Classification Search
None
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

Pervan, Darko, U.S. Appl. No. 14/938,612, entitled "Mechanical Locking System for Floor Panels," filed in the U.S. Patent and Trademark Office on Nov. 11, 2015

(Continued)

*Primary Examiner* — Ryan D Kwiecinski
(74) *Attorney, Agent, or Firm* — Buchanan Ingersoll & Rooney P.C.

(57) ABSTRACT

A tongue with edge sections that are used to glue the tongue into a groove of panel. A tongue for connection of a building panel, said tongue is of an elongated shape and made of molded plastic, the tongue including at least two protrusions at a first long edge of the tongue, wherein the protrusions are bendable in a plane parallel to the upper surface of the tongue and extending essentially in the parallel plane and, wherein the tongue has a second long edge, which is essentially straight over substantially the whole length of the tongue and the tongue includes a gluing part configured to be glued into a groove at an edge of the building panel.

17 Claims, 7 Drawing Sheets

Related U.S. Application Data division of application No. 13/540,107, filed on Jul. 2, 2012, now Pat. No. 8,572,922.

(60) Provisional application No. 61/504,576, filed on Jul. 5, 2011.

(51) Int. Cl.
*E04B 1/41* (2006.01)
*E04F 13/076* (2006.01)
*E04C 2/00* (2006.01)

(52) U.S. Cl.
CPC ..... *E04F 15/02* (2013.01); *E04F 15/02155* (2013.01); *E04F 15/04* (2013.01); *E04C 2002/001* (2013.01); *E04F 2015/02077* (2013.01); *E04F 2201/0138* (2013.01); *E04F 2201/023* (2013.01); *E04F 2201/0523* (2013.01); *E04F 2201/0535* (2013.01); *E04F 2201/0547* (2013.01); *Y10T 403/472* (2015.01)

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,110,728 A 3/1938 Hoggatt
2,204,675 A 6/1940 Grunert
2,266,464 A 12/1941 Kraft
2,277,758 A 3/1942 Hawkins
2,430,200 A 11/1947 Wilson
2,497,837 A 2/1950 Nelson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,872,712 A 2/1959 Brown et al.
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,187,612 A 6/1965 Hervey
3,271,787 A 9/1966 Clary
3,325,585 A 6/1967 Brenneman
3,331,180 A 7/1967 Vissing et al,
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,169,688 A 10/1979 Toshio
RE30,154 E * 11/1979 Jarvis ..... F16B 12/04 403/248
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorne
4,819,932 A 4/1989 Trotter, Jr.
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,671,575 A 9/1997 Wu
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,203,653 B1 3/2001 Seidner
6,216,409 B1 4/2001 Roy et al.
6,254,301 B1 7/2001 Hatch
6,295,779 B1 10/2001 Canfield
6,314,701 B1 11/2001 Meyerson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 * 9/2002 Nelson ..... E04F 15/04 52/570
6,450,235 B1 9/2002 Lee

(56) References Cited

U.S. PATENT DOCUMENTS 6,490,836 B1 12/2002 Moriau et al.
6,505,452 B1 * 1/2003 Hannig ..... B27F 1/04 52/582.1
6,546,691 B2 4/2003 Leopolder
6,553,724 B1 4/2003 Bigler
6,576,079 B1 6/2003 Kai
6,584,747 B2 7/2003 Kettler et al.
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,684,592 B2 2/2004 Martin
6,685,391 B1 2/2004 Gideon
6,729,091 B1 * 5/2004 Martensson ..... E04F 15/04 446/112
6,763,643 B1 7/2004 Martensson
6,766,622 B1 7/2004 Thiers
6,769,219 B2 8/2004 Schwitte et al.
6,769,835 B2 * 8/2004 Stridsman ..... E04F 15/02 404/41
6,802,166 B1 10/2004 Gerhard
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,137,229 B2 11/2006 Pervan
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,644,553 B2 * 1/2010 Knauseder ..... C09J 5/00 156/304.5
7,654,055 B2 * 2/2010 Ricker ..... A47B 47/0075 52/582.2
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 * 8/2011 Olofsson ..... E04F 15/02 52/489.1
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,375,673 B2 2/2013 Evjen
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,522,505 B2 9/2013 Beach
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,635,829 B2 1/2014 Schulte
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Darko et al.
8,938,929 B2 1/2015 Engström
8,959,866 B2 2/2015 Pervan
8,973,331 B2 3/2015 Boo
8,991,055 B2 3/2015 Cappelle
8,997,423 B2 4/2015 Mann
9,027,306 B2 5/2015 Pervan
9,051,738 B2 6/2015 Pervan et al.
9,068,360 B2 6/2015 Darko
9,091,077 B2 7/2015 Boo
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.

(56) References Cited

U.S. PATENT DOCUMENTS 9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,826 B2 1/2017 Pervan et al.
9,663,940 B2 5/2017 Boo
2001/0024707 A1 9/2001 Andersson et al.
2002/0031646 A1 3/2002 Chen et al.
2002/0046433 A1 4/2002 Sellman, Jr. et al.
2002/0069611 A1 6/2002 Leopolder
2002/0092263 A1 7/2002 Schulte
2002/0100231 A1 8/2002 Miller et al.
2002/0108343 A1 8/2002 Knauseder
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1* 12/2002 Nelson ..... E04F 15/04 52/582.1
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0154676 A1 8/2003 Schwartz
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0107659 A1 6/2004 Glockl
2004/0123548 A1* 7/2004 Gimpel ..... E04B 1/6162 52/582.1
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0244325 A1* 12/2004 Nelson ..... E04F 15/04 52/582.1
2004/0250492 A1 12/2004 Becker
2004/0255541 A1 12/2004 Thiers et al.
2004/0261348 A1 12/2004 Vulin
2005/0003132 A1 1/2005 Blix et al.
2005/0028474 A1 2/2005 Kim
2005/0050827 A1 3/2005 Schitter
2005/0138881 A1 6/2005 Pervan
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0099386 A1 5/2006 Smith
2006/0101769 A1 5/2006 Pervan
2006/0156670 A1 7/2006 Knauseder
2006/0174577 A1 8/2006 O'Neil
2006/0179754 A1 8/2006 Yang
2006/0236642 A1 10/2006 Pervan
2006/0260254 A1 11/2006 Pervan et al.
2006/0272262 A1* 12/2006 Pomberger ..... E04F 13/08 52/589.1
2007/0006543 A1* 1/2007 Engstrom ..... E04F 15/02 52/582.1
2007/0011981 A1 1/2007 Eiserman
2007/0028547 A1* 2/2007 Grafenauer ..... E04F 13/10 52/586.1
2007/0065293 A1 3/2007 Hannig
2007/0108679 A1 5/2007 Grothaus
2007/0151189 A1 7/2007 Yang et al.
2007/0175143 A1 8/2007 Pervan et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005989 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0172971 A1 7/2008 Pervan
2008/0216434 A1 9/2008 Pervan
2008/0216920 A1 9/2008 Pervan
2008/0236088 A1 10/2008 Hannig et al.
2008/0263975 A1 10/2008 Mead
2008/0295432 A1 12/2008 Pervan et al.
2008/0302044 A1 12/2008 Johansson
2009/0019806 A1 1/2009 Muehlebach
2009/0064624 A1* 3/2009 Sokol ..... E04F 15/02 52/589.1
2009/0100782 A1* 4/2009 Groeke ..... E04F 15/02 52/589.1
2009/0133353 A1 5/2009 Pervan et al.
2009/0151290 A1 6/2009 Liu
2009/0155612 A1 6/2009 Pervan et al.
2009/0173032 A1 7/2009 Prager et al.
2009/0193741 A1 8/2009 Cappelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0308014 A1 12/2009 Muehlebach
2010/0043333 A1* 2/2010 Hannig ..... E04F 15/02 52/582.2
2010/0083603 A1* 4/2010 Goodwin ..... E04F 15/02 52/589.1
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300029 A1 12/2010 Braun et al.
2010/0300030 A1 12/2010 Pervan et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan

(56) References Cited

U.S. PATENT DOCUMENTS

2011/0047922 A1 3/2011 Fleming, III
2011/0088344 A1 4/2011 Pervan et al.
2011/0088345 A1 4/2011 Pervan
2011/0088346 A1 4/2011 Hannig
2011/0131916 A1* 6/2011 Chen ..... E04F 15/02 52/588.1
2011/0154763 A1 6/2011 Bergelin et al.
2011/0162312 A1 7/2011 Schulte
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0252733 A1 10/2011 Pervan
2011/0271631 A1 11/2011 Engstrom
2011/0271632 A1* 11/2011 Cappelle ..... E04F 15/02 52/582.2
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1* 2/2012 Vermeulen ..... E04F 15/02038 52/588.1
2012/0055112 A1 3/2012 Engström
2012/0096801 A1 4/2012 Cappelle
2012/0124932 A1 5/2012 Schulte et al.
2012/0151865 A1 6/2012 Pervan et al.
2012/0174515 A1 7/2012 Pervan
2012/0174519 A1 7/2012 Schulte
2012/0174520 A1 7/2012 Pervan
2012/0174521 A1 7/2012 Schulte et al.
2012/0192521 A1 8/2012 Schulte
2012/0279161 A1 11/2012 Håkansson et al.
2012/0304590 A1 12/2012 Engström
2013/0008117 A1 1/2013 Pervan
2013/0008118 A1 1/2013 Baert et al.
2013/0014463 A1 1/2013 Pervan
2013/0019555 A1 1/2013 Pervan
2013/0025231 A1 1/2013 Vermeulen
2013/0036695 A1 2/2013 Durnberger
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1* 5/2013 Devos ..... E04F 13/0894 52/309.1
2013/0111845 A1 5/2013 Pervan
2013/0145708 A1 6/2013 Pervan
2013/0152500 A1 6/2013 Engström
2013/0160390 A1 6/2013 Stockl
2013/0160391 A1 6/2013 Pervan et al.
2013/0167467 A1 7/2013 Vermeulen et al.
2013/0219806 A1 8/2013 Carrubba
2013/0232905 A2 9/2013 Pervan
2013/0239508 A1 9/2013 Darko et al.
2013/0263454 A1 10/2013 Boo et al.
2013/0263547 A1 10/2013 Boo
2013/0283719 A1 10/2013 Döhring et al.
2013/0318906 A1 12/2013 Pervan et al.
2014/0007539 A1 1/2014 Pervan et al.
2014/0020324 A1 1/2014 Pervan
2014/0026513 A1* 1/2014 Bishop ..... E04F 15/02016 52/589.1
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Darko
2014/0109506 A1 4/2014 Pervan et al.
2014/0123586 A1 5/2014 Pervan et al.
2014/0130437 A1 5/2014 Cappelle
2014/0144096 A1* 5/2014 Vermeulen ..... E04F 15/02038 52/582.2
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0305065 A1 10/2014 Pervan
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0047284 A1* 2/2015 Cappelle ..... E04F 15/02 52/311.1
2015/0059281 A1 3/2015 Pervan
2015/0089896 A2 4/2015 Pervan et al.
2015/0152644 A1 6/2015 Boo
2015/0167318 A1 6/2015 Pervan
2015/0176289 A1* 6/2015 Hannig ..... E04F 13/0894 52/582.2
2015/0176619 A1* 6/2015 Baker ..... E04F 13/0894 52/586.2
2015/0211239 A1 7/2015 Pervan
2015/0233125 A1 8/2015 Pervan et al.
2015/0267419 A1 9/2015 Darko
2015/0300029 A1 10/2015 Pervan
2015/0330088 A1 11/2015 Derelov
2015/0337537 A1 11/2015 Boo
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv
2017/0037641 A1 2/2017 Nygren et al.
2017/0081860 A1 3/2017 Boo

FOREIGN PATENT DOCUMENTS

DE 138 992 C 7/1901
DE 142 293 C 7/1902
DE 2 159 042 6/1973
DE 25 05 489 A1 8/1976
DE 33 43 601 A1 6/1985
DE 33 43 601 C2 6/1985
DE 39 32 980 A1 11/1991
DE 33 43 15 273 A1 11/1993
DE 42 42 530 A1 6/1994
DE 196 01 322 A 5/1997
DE 299 22 649 U1 4/2000
DE 200 01 788 U1 6/2000
DE 200 02 744 U1 8/2000
DE 199 40 837 A1 11/2000
DE 199 58 225 A1 6/2001
DE 202 05 774 U1 8/2002
DE 203 20 799 U1 4/2005
DE 10 2004 055 951 A1 7/2005
DE 10 2004 001 363 A1 8/2005
DE 10 2005 002 297 A1 8/2005
DE 10 2004 054 368 A1 5/2006
DE 10 2005 024 366 A1 11/2006
DE 10 2006 024 184 A1 11/2007
DE 10 2006 037 614 B3 12/2007

(56) References Cited

FOREIGN PATENT DOCUMENTS

| | | | |
|---|---|---|---|
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| DE | 10 2009 041 297 | A1 | 3/2011 |
| DE | 10 2010 012 572 | B3 | 7/2011 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 251 219 | A | 10/2002 |
| EP | 1 308 577 | A2 | 5/2003 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| EP | 2 063 045 | A2 | 5/2009 |
| EP | 2 078 801 | A1 | 7/2009 |
| EP | 2 236 694 | A1 | 10/2010 |
| EP | 2 270 291 | A1 | 1/2011 |
| EP | 2 270 291 | B1 | 5/2011 |
| EP | 2 333 195 | A1 | 5/2011 |
| EP | 2 388 409 | A2 | 11/2011 |
| EP | 2 078 801 | B1 | 3/2012 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 8-086080 | A | 4/1996 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/053257 | A1 | 6/2004 |
| WO | WO 2004/053257 | A8 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2008/116623 | A1 | 10/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/028621 | A1 | 3/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2010/142671 | A1 | 12/2010 |
| WO | WO 2011/001326 | A2 | 1/2011 |
| WO | WO 2011/012104 | A2 | 2/2011 |
| WO | WO 2011/012105 | A1 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/117179 | A1 | 9/2011 |

(56) References Cited

FOREIGN PATENT DOCUMENTS

| | | | |
|---|---|---|---|
| WO | WO 2011/127981 | A1 | 10/2011 |
| WO | WO 2011/151758 | A2 | 12/2011 |
| WO | WO 2013/025164 | A1 | 2/2013 |
| WO | WO 2013/087190 | A1 | 6/2013 |
| WO | WO 2013/151493 | A1 | 10/2013 |

OTHER PUBLICATIONS

Pervan, Darko, U.S. Appl. No. 14/951,976, entitled "Mechanical Locking System for Floor Panels," filed in the U.S. Patent and Trademark Office on Nov. 25, 2015.
Pervan, Darko, et al., U.S. Appl. No. 14/962,291, entitled "Mechanical Locking System for Floor Panels," filed in the U.S. Patent and Trademark Office on Dec. 8, 2015.
International Search Report dated Nov. 19, 2012 in PCT/SE2012/050764, Swedish Patent Office, Stockholm, Sweden, 9 pages.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical. Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html); 2000, 12 pages.
Pervan; Darko, U.S. Appl. No. 14/683,340 entitled "Mechanical Locking System for Floor Panels," filed in the U.S. Patent and Trademark Office on Apr. 10, 2015.
Pervan, Darko, et al., U.S. Appl. No. 14/701,959 entitled "Mechanical Locking system for Floor Panels," filed in the U.S. Patent and Trademark Office on May 1, 2015.
Derelov, Peter, U.S. Appl. No. 14/709,913 entitled "Building Panel with a Mechanical Locking System," filed in the U.S. Patent and Trademark Office on May 12, 2015.
Pervan, Darko, U.S. Appl. No. 14/646,567 entitled "Mechanical Locking System for Floor Panels," filed in the U.S. Patent and Trademark Office on May 21, 2015.
Pervan, Darko, U.S. Appl. No. 14/730,691 entitled "Mechanical Locking System for Panels and Method for Installing Same," filed in the U.S. Patent and Trademark Office on Jun. 4, 2015.
Pervan, Darko, et al., U.S. Appl. No. 15/048,252, entitled "Mechanical Locking System for Floor Panels," filed in the U.S. Patent and Trademark Office Feb. 19, 2016.
Pervan, Darko, U.S. Appl. No. 15/148,820, entitled "Mechanical Locking System for Panels and Method of Installing Same," filed in the U.S. Patent and Trademark Office May 6, 2016.
Pervan, Darko, U.S. Appl. No. 15/160,311, entitled "Mechanical Locking System for Floor Panels," filed in the U.S. Patent and Trademark Office May 20, 2016.
Pervan, Darko, et al., U.S. Appl. No. 15/172,926, entitled "Mechanical Locking of Floor Panels with a Flexible Bristle Tongue," filed in the U.S. Patent and Trademark Office on Jun. 3, 2016.
Pervan, Darko, et al., U.S. Appl. No. 15/175,768, entitled "Mechanical Locking System for Floor Panels," filed in the U.S. Patent and Trademark Office on Jun. 7, 2016.
Pervan, Darko, et al., U.S. Appl. No. 15/217,023, entitled "Mechanical Locking System for Floor Panels," filed in the U.S. Patent and Trademark Office on Jul. 22, 2016.
Derelov, Peter, U.S. Appl. No. 15/229,575, entitled "Building Panel With a Mechanical Locking System," filed in the U.S. Patent and Trademark Office on Aug. 5, 2016.
Pervan, Darko, U.S. Appl. No. 15/261,071, entitled "Mechanical Locking System for Floor Panels," filed in the U.S. Patent and Trademark Office on Sep. 9, 2016.
Extended European Search Report dated Apr. 30, 2015 in EP 12 806 893.9, European Patent Office, Munich, DE, 6 pages.
Pervan, Darko, U.S. Appl. No. 15/603,913, entitled "Mechanical Locking System for Floor Panels," filed in the U.S. Patent and Trademark Office on May 24, 2017.
Boo Christian, U.S. Appl. No. 15/365,546, entitled "Building Panel With a Mechanical Locking System," filed in the U.S. Patent and Trademark office on Nov. 30, 2016.

* cited by examiner

MECHANICAL LOCKING OF FLOOR PANELS WITH A GLUED TONGUE

CROSS REFERENCE TO RELATED APPLICATIONS

The present application is a continuation of U.S. application Ser. No. 14/042,887, filed on Oct. 1, 2013, which is a divisional of U.S. application Ser. No. 13/540,107, filed on Jul. 2, 2012, which claims the benefit of U.S. Provisional Application No. 61/504,576, filed on Jul. 5, 2011, the benefit of Swedish Application No. 1150635-9, filed on Jul. 5, 2011, Swedish Application No. 1150775-3, filed on Aug. 26, 2011, and Swedish Application No. 1150777-9, filed on Aug. 29, 2011. The entire contents of each of U.S. application Ser. No. 14/042,887, U.S. application Ser. No. 13/540,107, U.S. Provisional Application No. 61/504,576, Swedish Application No. 1150635-9, Swedish Application No. 1150775-3, and Swedish Application No. 1150777-9 are hereby incorporated herein by reference in their entirety.

AREA OF INVENTION

The invention generally relates to the field of floor panels with mechanical locking systems with a flexible and displaceable tongue. The invention also relates to a partly bendable tongue for a building panel with such a mechanical locking system.

BACKGROUND OF THE INVENTION

In particular, yet not restrictive manner, the invention concerns a tongue for a floor panel and a set of floor panels mechanically joined to preferably a floating floor. However, the invention is applicable to building panels in general as well. More particularly invention relates to the type of mechanically locking system that comprises a flexible or partly flexible tongue and/or displaceable tongue, in order to facilitate the installation of building panels.

A floor panel of this type is presented in WO 2006/043893, which discloses a floor panel with a locking system comprising a locking element cooperating with a locking groove, for horizontal locking, and a flexible tongue cooperating with a tongue groove, for locking in a vertical direction. The flexible tongue, which may be made of plastic, bends in the horizontal plane and is displaced in a groove during connection of two floor panels. The flexible tongue allows the floor panels to be installed by vertical folding or solely by vertical movement.

The flexible tongues are generally connected into a groove with friction connections. One disadvantage with such connection is that the tongue may fall out from the groove when floor panels swell or shrink or when the groove is not made with sufficient tolerances.

It is known that the tongue may be glued into the groove. The problem is that it is difficult to glue plastic to wood and that part of the glue also glues the tongue in such a way that it cannot be displaced during the connection of the floor panels. The present invention provides a simple way to glue a flexible and displaceable tongue into a groove.

SUMMARY OF THE INVENTION

The aim of present invention is to provide a tongue that is easy to glue in a groove. Useful areas for the invention are floor panels, preferably to be installed floating, of any shape and material e.g. laminate, wood, HDF, veneer or stone. However, the invention is applicable to building panels in general.

The tongue may be used in any mechanical locking system that facilitates the assembling of building panels. The tongue may be used in the mechanical locking system for vertical locking of two adjacent floor panels. The locking system may further comprise additional elements for horizontal locking of the adjacent floor panels.

A first aspect of the invention is a tongue for connection of a building panel, said tongue is of an elongated shape and made of moulded plastic. The tongue comprises protrusions, preferably bow shaped, at a first long edge of the tongue. The protrusions are bendable in a plane parallel to the upper surface of the tongue and extending essentially in the parallel plane. The tongue has a second long edge, which is essentially straight over substantially the whole length of the tongue. The tongue comprises a gluing part configured to be glued into a groove at an edge of the building panel.

The gluing part may be an edge section, which is spaced in the length direction of the tongue from the protrusions.

The edge section may comprise a glue pocket.

The edge section may comprise a flexible link that connects the edge section to the main tongue body.

The tongue may be provided with said edge sections at each edge of the tongue.

The advantage is that the edge sections are spaced from the main tongue body that is displaced during locking. The risk that glue will be applied in the part of the groove where the tongue has to be displaceable is eliminated.

The edge section may be provided with a breaking part, configured to be broken when the tongue is inserted into the groove.

The edge section may be provided with an outer protruding stop part, which overlaps an inner stop part, which protrudes from the edge of the tongue, wherein said inner and outer stop part cooperates to limit the displacement of the tongue in the groove.

The edge section may be provided with a protruding friction connection, configured to hold the tongue in the correct position until the glue is cured.

The gluing part may be a gluing strip extending in the longitudinal direction of the tongue, preferably along substantially the whole length of the tongue, and wherein the gluing strip is attached to the outer end of some of the protrusions.

The advantage with such a gluing strip is that the tongue is attached steady to the groove of the building panel and with an improved position tolerance. It is also easier to provide the glue along the bottom of the groove, which is made possible by this embodiment.

The outer end of the protrusions, at a first edge of the tongue, may be free and not attached to the gluing strip.

The outer end of the protrusions, at a second edge of the tongue, may be attached to the gluing strip.

The outer end of the protrusions may be provided with a thinner section for facilitating the bending of the protrusion.

The outer end of the gluing strip may be provided with a bow shaped part for facilitating the insertion of the tongue into the groove.

There may be an angle between the protrusions and the longitudinal direction of the tongue.

A second aspect of the invention is a building panel provided with a tongue, according to the first aspect, in a sidewardly open groove at edge of the panel.

BRIEF DESCRIPTION OF THE DRAWINGS

The disclosure will in the following be described in connection to exemplary embodiments and in greater detail with reference to the appended exemplary drawings, wherein.

DESCRIPTION OF EMBODIMENTS OF THE INVENTION

Figure 1:
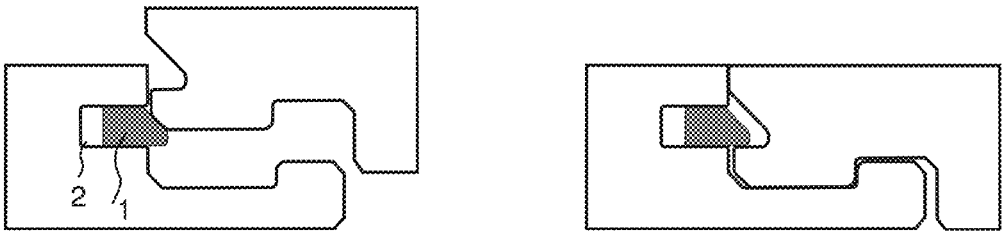
FIG. 1 illustrates a known locking system comprising a displaceable tongue.

FIG. 1 shows a vertical locking of two panels where a flexible and displaceable tongue 1 is displaced in a fixing groove 2.

Figure 2:
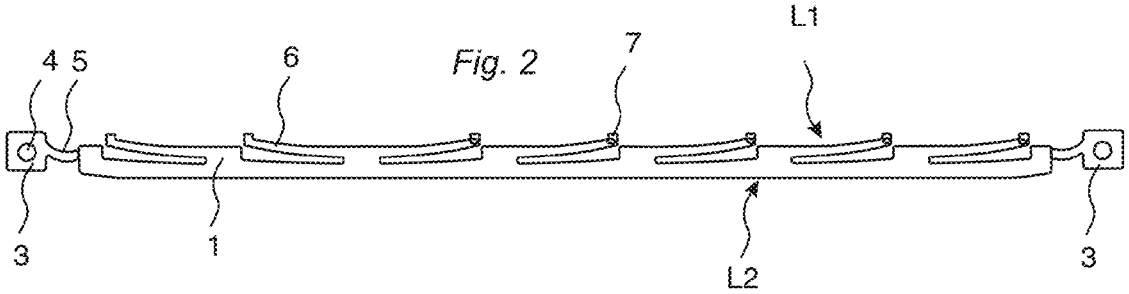
FIG. 2 shows a first embodiment of the tongue according to the invention.

FIG. 2 shows a first embodiment of a flexible tongue 1, made of moulded plastic material, which comprises two edge sections 3, which are intended to be used to glue the tongue into a groove 2.

The tongue is of an elongated shape and comprising in this preferred embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

The edge section 3 comprises a glue pocket 4 where glue is applied, preferably by an inserting equipment, which also positions the tongue into a groove of a panel. Friction connections 7 may be used to hold the tongue in the groove until the glue cures.

Figure 3A:
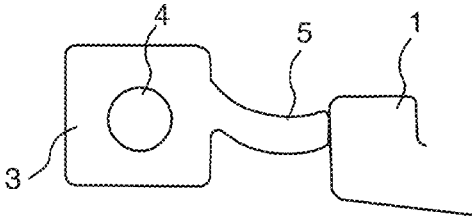
FIGS. 3*a* and 3*b* shows an edge section of the first embodiment of the tongue
Figure 3B:
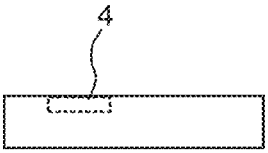

FIG. 3*a* shows the edge section from above. FIG. 3*b* shows a cross section of the edge section. A glue pocket 4 is preferably formed as a local cavity.

The edge section is connected to the main tongue body with a flexible link 5 that allow the tongue to move in the groove 2 and in relation to the edge section 3 that is glued into a groove 2. A wide variety of glues may be used, preferably hot melt based glues.

Figure 4:
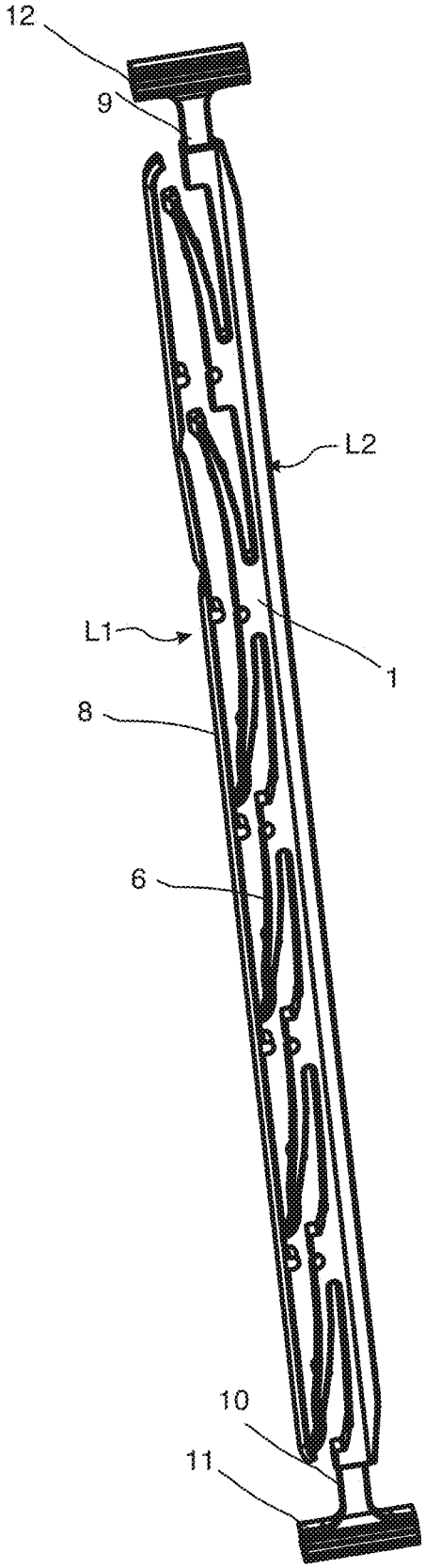
FIG. 4 shows a second embodiment of the tongue.

FIG. 4 shows a second embodiment of a flexible tongue 1, made of moulded plastic material, which is provided with a gluing strip 8 configured to be used to glue the tongue into a groove 2. Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The tongue is of an elongated shape and comprising in the second embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

Figure 5:
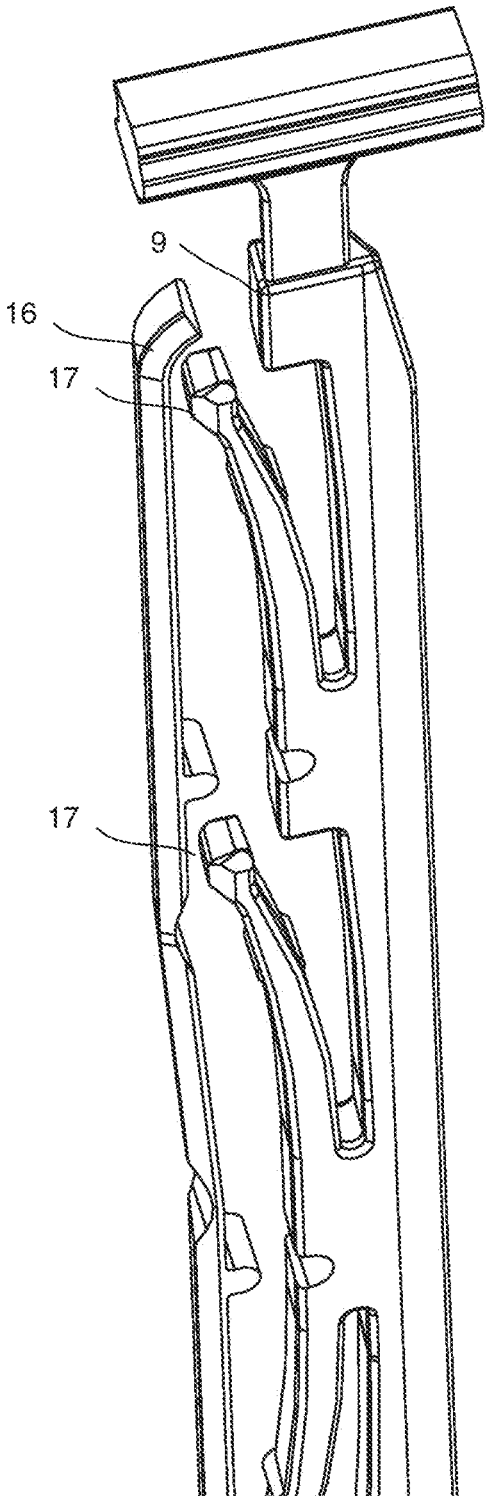
FIG. 5 shows first edge section of the second embodiment.

FIG. 5 shows the first edge 9 of second embodiment of the tongue. The outer ends 17 of the protrusions 6 at the first edge are free from the gluing strip 8 to facilitate a movement of the second long edge L2 along the groove 2 of the building panel. The outer part of the gluing strip is bow shaped 16 to facilitate insertion of the tongue into the groove 2 of the building panel.

Figure 6:
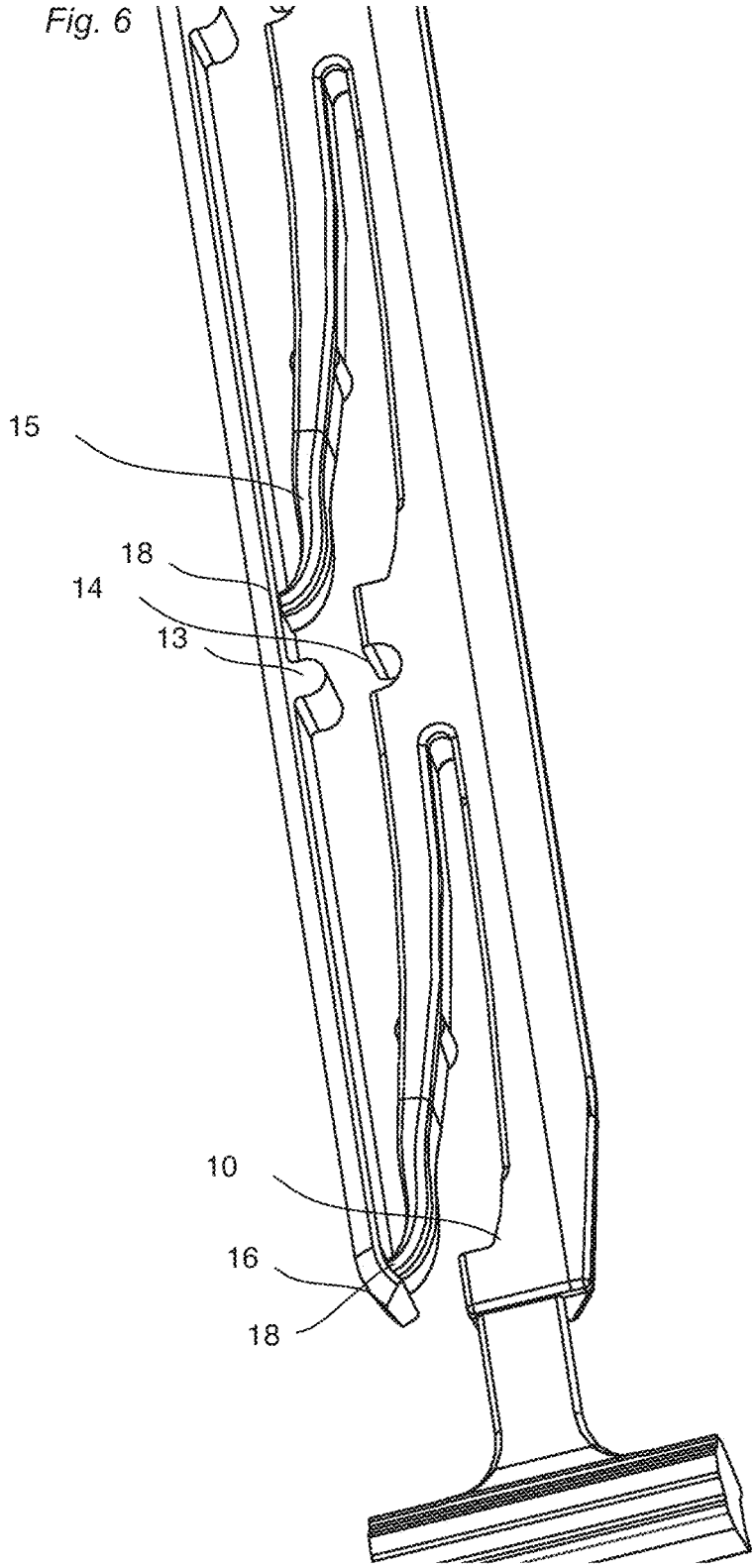
FIG. 6 shows second edge section of the second embodiment.

FIG. 6 shows the second edge 10 of second embodiment of the tongue 1. The outer ends 18 of the protrusions 6 at the second edge are attached to the gluing strip 8. The outer part 16 of the gluing strip is bow shaped to facilitate insertion of the tongue into the groove 2 of the building panel.

The outer ends of the protrusions are provided with a thinner section 15 to improve the bending of the tongue.

The gluing strip is provided with a protrusion 13, which makes it easier to remove the tongue from the moulding tool. The tongue body is provided with an aperture 14 adapted to the size of the gluing strip protrusion 13, which make it possible to push the second long edge L2 of the tongue 1 further into the groove 2 of the building panel.

Figure 7:
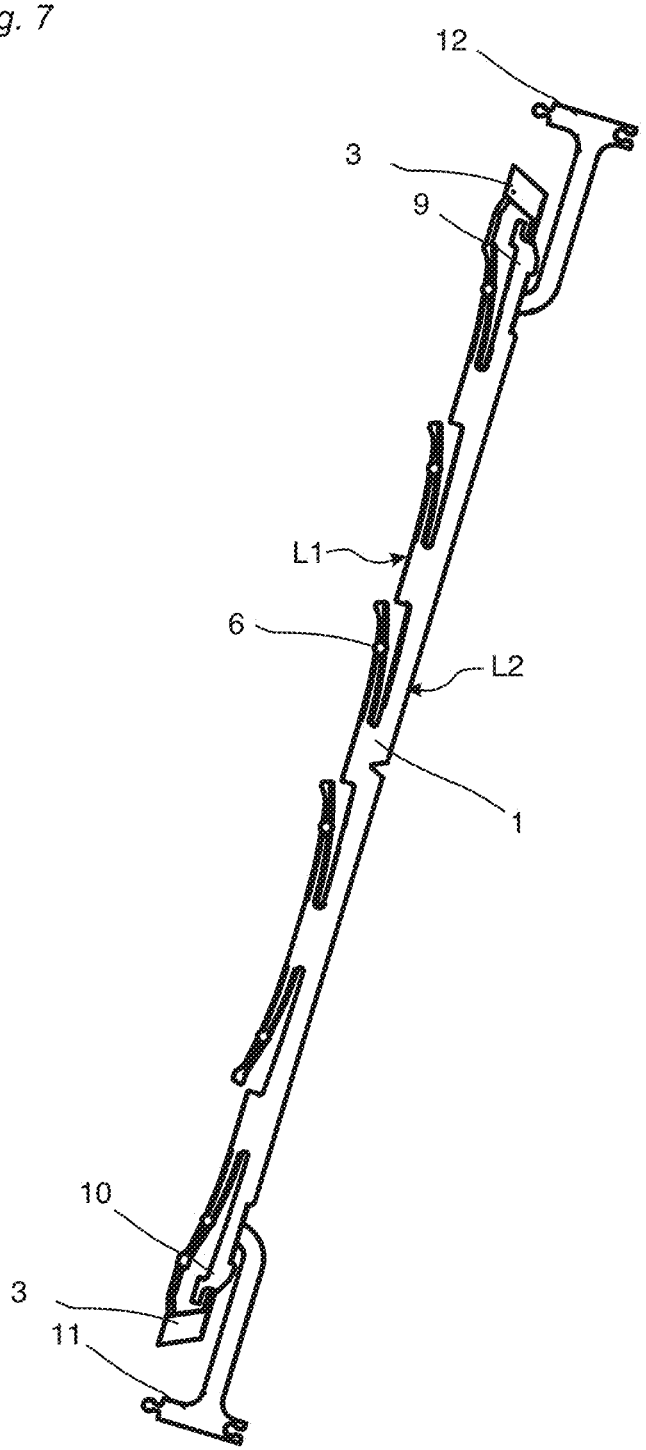
FIG. 7 shows a third embodiment of the tongue.

FIG. 7 shows a third embodiment of a flexible tongue 1, made of moulded plastic material, which is provided with an edge sections 3 configured to be used to glue the tongue into a groove 2. The tongue has a second long edge L2, which is essentially straight over substantially the whole length of the tongue. The tongue is of an elongated shape and comprising in the second embodiment at least two protrusions 6 at a first long edge L1.

Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The protrusions are bendable in a plane parallel to the upper surface of the tongue and extending essentially in the parallel plane.

Figure 8:
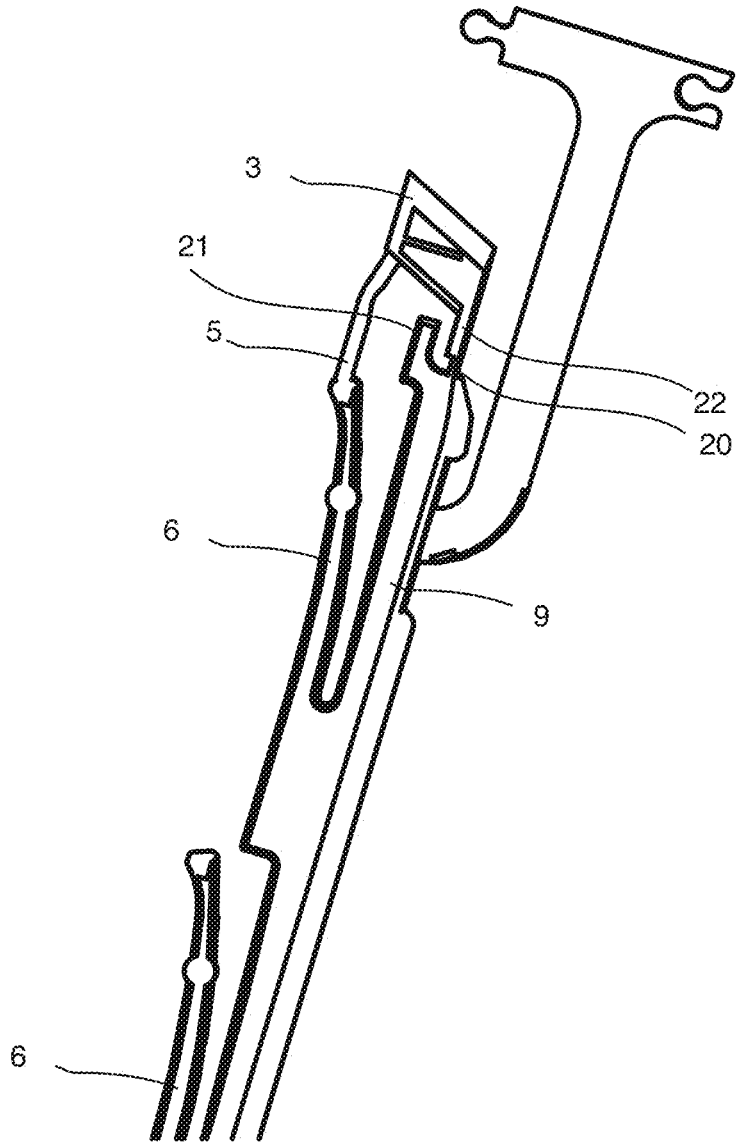
FIG. 8 shows first edge section of the third embodiment.

FIG. 8 shows the first edge 9 of the third embodiment of the tongue.

Figure 9:
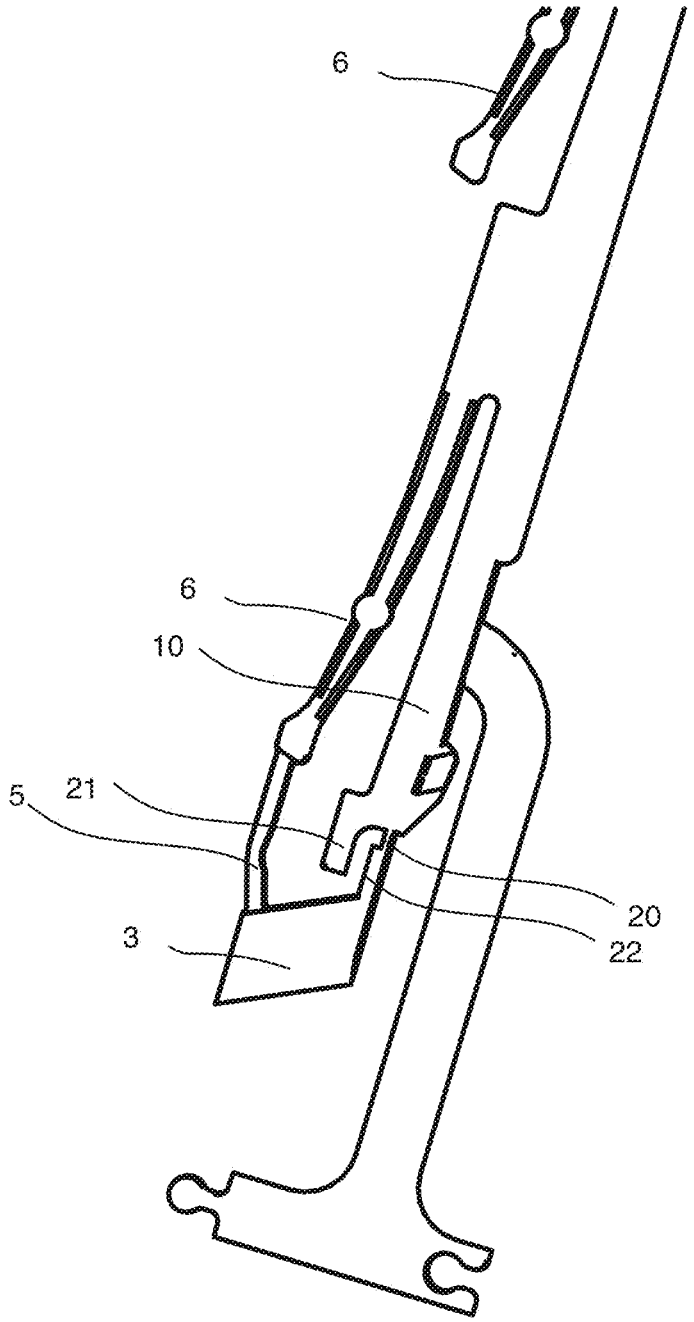
FIG. 9 shows second edge section of the third embodiment.

FIG. 9 shows the second edge 10 of the third embodiment of the tongue 1.

The third embodiment of the tongue is provided with said edge sections 3 on each edge of the tongue. Said edge section is provided with a protruding friction connection, configured to hold the tongue in the correct position until the glue is cured. A flexible link 5 connects the edge section 3 to the main tongue body.

The edge sections are each provided with an outer protruding stop part 22, which overlap an inner stop part 21, which protrudes from each edge 9, 10 of the tongue, wherein said inner and outer stop part cooperates to limit the displacement of the tongue 1 in the groove 2.

The edge sections are further provided with a breaking part 20, configured to be broken when the tongue 1 is inserted into the groove 2.

Glue may be used that glues to a wood based material and cures such that a part of the glue will form a small protrusion in the glue pocket and will connect the tongue mechanically even if the glue as such cannot glue the plastic material that is used to form the tongue.

The principles shown above may be used to connect all types of tongues that are intended to be displaceable in a groove. Even tongues that are not flexible and displaceable may be connected according to the described principles.

The invention claimed is:

1. A tongue for connection of a building panel, said tongue is of an elongated shape and made of moulded plastic, the tongue comprising:

an elongate main body of the tongue, an edge section connected to at least one end of the elongate main body, a gluing part configured to be glued into a groove at an edge of the building panel, a first long edge including at least two protrusions, and the tongue is configured so that the protrusions face toward an inside the groove when the tongue is inserted into the groove, and a second long edge, opposite the first long edge, which second long edge is straight over substantially a whole length of the elongate main body of the tongue, and the tongue is configured so that the second long edge protrudes out of the groove when the tongue is inserted into the groove, wherein the gluing part is in the edge section of the tongue, wherein the gluing part comprises a recess in the edge section forming a glue pocket having an opening which faces a wall of the groove when the tongue is inserted into the groove, and the glue pocket does not penetrate all the way through the edge section.

2. The tongue as claimed in claim 1, wherein the tongue is provided with a flexible link that connects the edge section to the elongate main body of the tongue, the flexible link including a section that is more flexible than the elongate main body of the tongue.

3. The tongue as claimed in claim 2, wherein the protrusions are bendable in a plane parallel to an upper surface of the tongue and extending essentially in the plane, and wherein the edge section is spaced in a length direction along the first long edge of the tongue from the protrusions.

4. The tongue as claimed in claim 3, wherein at least one of the protrusions is provided with a protruding friction connection, configured to hold the tongue in position until a glue in the glue pocket is cured.

5. The tongue as claimed in claim 3, wherein the protrusions are bow shaped.

6. The tongue as claimed in claim 3, wherein there is an angle between the protrusions and a longitudinal direction of the tongue.

7. The tongue as claimed in claim 2, wherein the tongue is a monolithic construction made as one unitary piece.

8. The tongue as claimed in claim 2, wherein:

the elongate main body defines a main plane wherein the first long edge extends along a first side of the elongate main body facing in a first direction and the second long edge extends along a second side of the elongate main body facing in a second direction, the at least two protrusions project in the main plane in the first direction from the first side of the elongate main body of the tongue, the gluing part includes a surface that extends parallel to the main plane, the recess being formed in the parallel surface, and when in a relaxed state, the second long edge extends further in the second direction than the edge section and the gluing part.

9. The tongue as claimed in claim 1, further comprising a second edge section at an opposite end of the elongate main body.

10. The tongue as claimed in claim 1, wherein the at least two protrusions protrude in the same direction at the first long edge of the tongue.

11. The tongue as claimed in claim 10, wherein the at least two protrusions are bendable in a plane parallel to an upper surface of the tongue and extend substantially in the plane.

12. The tongue as claimed in claim 1, wherein the tongue is a monolithic construction made as one unitary piece.

13. The tongue as claimed in claim 1, wherein:

the elongate main body defines a main plane wherein the first long edge extends along a first side of the elongate main body facing in a first direction and the second long edge extends along a second side of the elongate main body facing in a second direction, the at least two protrusions project in the main plane in the first direction from the first side of the elongate main body of the tongue, the gluing part includes a surface that extends parallel to the main plane, the recess being formed in the parallel surface, and when in a relaxed state, the second long edge extends further in the second direction than the edge section and the gluing part.

14. A building panel provided with a tongue, according to claim 1, wherein said tongue is displaceable in a groove at an edge of the building panel.

15. A tongue for connection of a building panel, said tongue is of an elongated shape and made of moulded plastic, the tongue comprising:

an elongate main body of the tongue, an edge section connected to at least one end of the elongate main body, a gluing part configured to be glued into a groove at an edge of the building panel, a first long edge including at least two protrusions, and the tongue is configured so that the protrusions face toward an inside the groove when the tongue is inserted into the groove, and a second long edge, opposite the first long edge, which second long edge is straight over substantially a whole length of the elongate main body of the tongue, and the tongue is configured so that the second long edge protrudes out of the groove when the tongue is inserted into the groove, wherein the elongate main body defines a main plane wherein the first long edge extends along a first side of the elongate main body facing in a first direction and the second long edge extends along a second side of the elongate main body facing in a second direction, wherein the gluing part is in the edge section of the tongue, wherein the gluing part comprises a glue pocket having an opening which faces a wall of the groove when the tongue is inserted into the groove, wherein the first long edge extends along a first side of the elongate main body facing in a first direction and the second long edge extends along a second side of the elongate main body facing in a second direction, the at least two protrusions project in the main plane in the first direction from the first side of the elongate main body of the tongue, the gluing part includes a surface that extends parallel to the main plane, the glue pocket being formed in the parallel surface, and when in a relaxed state, the second long edge extends further in the second direction than the edge section and the gluing part.

16. A method for fixing a tongue to a building panel, said tongue comprising:

an elongate main body, a first long edge including at least two protrusions, the first long edge extending along a first side of the elongate main body, and a second long edge, opposite the first long edge, which second long edge is straight over substantially a whole length of the elongate main body of the tongue and extends along a second side of the elongate main body, an edge section connected to at least one end of the elongate main body, wherein the edge section includes a recess in the edge section forming a glue pocket, which glue pocket does not penetrate all the way through the edge section, the method comprising:

putting glue into the glue pocket, inserting the tongue into a groove formed at an edge of the building panel so that the protrusions are inserted all of the way into the groove, the second long edge protrudes from the groove, and the edge section is within the groove, and securing the edge section to the building panel with the glue.

17. The method as claimed in claim 16, wherein a second edge section is connected to a second end of the elongate main body opposite the at least one end, the second edge section includes a second recess in the second edge section forming a second glue pocket, which second glue pocket does not penetrate all the way through the edge section, and when inserting the tongue into the groove, the second edge section is within the groove and is secured to the groove with glue.

* * * * *